US010377957B2

(12) United States Patent
Lopez Garcia et al.

(10) Patent No.: US 10,377,957 B2
(45) Date of Patent: Aug. 13, 2019

(54) PROCESS FOR THE TREATMENT OF A GASOLINE

(71) Applicant: IFP Energies nouvelles, Rueil-Malmaison (FR)

(72) Inventors: Clementina Lopez Garcia, Lyons (FR); Philibert Leflaive, Mions (FR); Annick Pucci, Croissy sur Seine (FR); Jean-Luc Nocca, Rueil-Malmaison (FR)

(73) Assignee: IFP Energies nouvelles, Rueil-Malmaison (FR)

( * ) Notice: Subject to any disclaimer, the term of this patent is extended or adjusted under 35 U.S.C. 154(b) by 105 days.

(21) Appl. No.: 15/479,760

(22) Filed: Apr. 5, 2017

(65) Prior Publication Data

US 2017/0292080 A1 Oct. 12, 2017

(30) Foreign Application Priority Data

Apr. 8, 2016 (FR) ..... 16 53105

(51) Int. Cl.
*C10G 45/02* (2006.01)
*C10G 67/02* (2006.01)
(Continued)

(52) U.S. Cl.
CPC ..... *C10G 67/02* (2013.01); *C10G 45/02* (2013.01); *C10G 65/04* (2013.01); *C10G 65/16* (2013.01);
(Continued)

(58) Field of Classification Search
None
See application file for complete search history.

(56) References Cited

U.S. PATENT DOCUMENTS

2007/0095725 A1* 5/2007 Podrebarac ..... C10G 65/04 208/209
2007/0246399 A1* 10/2007 Picard ..... C10G 45/02 208/78
2014/0054198 A1 2/2014 Podrebarac et al.

FOREIGN PATENT DOCUMENTS

WO 2015165664 A1 11/2015

OTHER PUBLICATIONS

Search Report for FR-16/53.105 dated Dec. 21, 2016.
English Abstract for WO2015165664, Publication Date: Nov. 5, 2015.

* cited by examiner

*Primary Examiner* — Philip Y Louie
(74) *Attorney, Agent, or Firm* — Millen, White, Zelano and Branigan, P.C.

(57) ABSTRACT

A process for the treatment of a gasoline containing sulphur-containing compounds, olefins and diolefins, comprising the following steps:

a) fractionating the gasoline in a manner such as to recover at least one intermediate gasoline cut, MCN, comprising hydrocarbons and wherein the temperature difference (ΔT) between the 5% and 95% by weight distillation points is less than 60° C.;

b) desulphurizing the intermediate gasoline cut MCN alone and in the presence of a hydrodesulphurization catalyst and hydrogen in a manner such as to produce a partially desulphurized intermediate gasoline cut MCN; and c) fractionating, in a splitter, the at least partially desulphurized intermediate gasoline cut MCN which has not undergone catalytic treatment subsequent to step b), in a manner such as to recover an intermediate gasoline with low sulphur and mercaptans contents from the column
(Continued)

head and a cut of hydrocarbons containing sulphur-containing compounds including mercaptans from the column bottom.

16 Claims, 3 Drawing Sheets

(51) Int. Cl.
*C10G 65/04* (2006.01)
*C10G 65/16* (2006.01)

(52) U.S. Cl.
CPC ... *C10G 2300/202* (2013.01); *C10G 2400/02* (2013.01)

PROCESS FOR THE TREATMENT OF A GASOLINE

The present invention relates to a process for reducing the quantity of sulphur-containing compounds in an olefinic type gasoline, in order to produce a gasoline that is said to be desulphurized. The process in accordance with the invention can in particular be used to produce gasoline cuts with a low mercaptans content, and in particular a low recombinant mercaptans content.

PRIOR ART

The production of gasolines complying with new environmental standards requires a substantial reduction in their sulphur content to values which generally do not exceed 50 ppm (mg/kg), and are preferably less than 10 ppm.

It is also known that converted gasolines, and more particularly those obtained from catalytic cracking, which may represent 30% to 50% of the gasoline pool, have high olefins and sulphur contents.

For this reason, almost 90% of the sulphur present in the gasolines can be attributed to gasolines obtained from catalytic cracking processes, which will henceforth be termed FCC (Fluid Catalytic Cracking) gasoline. FCC gasolines thus constitute the preferred feed for the process of the present invention.

Among the possible pathways for producing fuels with a low sulphur content, that which has become very popular consists of specifically treating the sulphur-rich gasoline bases using hydrodesulphurization processes in the presence of hydrogen and a catalyst. Traditional processes desulphurize the gasolines in a non-selective manner by hydrogenating a large proportion of the monoolefins, which results in a substantial drop in the octane number and a high hydrogen consumption. The most recent processes, such as the Prime G+ process (trade mark), can be used to desulphurize olefin-rich cracked gasolines while limiting the hydrogenation of monoolefins and as a result the octane number drop and the high consumption of hydrogen that ensues. Examples of processes of this type are described in patent applications EP 1 077 247 and EP 1 174 485.

As described in patent applications EP 1 077 247 and EP 1 800 748, it is advantageous to carry out a step for selective hydrogenation of the feed to be treated prior to the hydrotreatment step. This first hydrogenation step essentially consists of selectively hydrogenating the diolefins, while at the same time transforming the saturated light sulphur-containing compounds by making them heavier (by increasing their molecular weight). These sulphur-containing compounds may have a boiling point that is lower than the boiling point of thiophene, such as methanethiol, ethanethiol, propanethiol and dimethylsulphide. By fractionating the gasoline obtained from the selective hydrogenation step, a light desulphurized gasoline cut (or LCN, Light Cracked Naphtha) mainly composed of monoolefins containing 5 or 6 carbon atoms is produced without a loss of octane number, which can be upgraded to the gasoline pool in order to formulate a vehicle fuel. Under specific operating conditions, this hydrogenation selective carries out hydrogenation, at least partial or even total, of the diolefins present in the feed to be treated into monoolefinic compounds which have a better octane number. Another effect of selective hydrogenation is to prevent the gradual deactivation of the selective hydrodesulphurization catalyst and/or to avoid gradual clogging of the reactor due to the formation of polymerization gums at the surface of the catalysts or in the reactor. In fact, polyunsaturated compounds are unstable and have a tendency to form gums by polymerization.

Patent application EP 2 161 076 discloses a process for the selective hydrogenation of polyunsaturated compounds, and more particularly of diolefins, in order to carry out joint molecular weight increase of the light sulphur-containing compounds such as mercaptans or sulphides. That process employs a catalyst containing at least one metal from group VIb and at least one non-noble metal from group VIII deposited on a porous support.

Obtaining a gasoline with a very low sulphur content, typically with a content of less than 10 ppm by weight as required in Europe, also requires at least one hydrodesulphurization step, which consists of converting the organosulphur compounds into $H_2S$. However, if this step is not controlled correctly, it may cause hydrogenation of a large proportion of the monoolefins present in the gasoline, which then results in a substantial drop in the octane number of the gasoline as well as an over-consumption of hydrogen. Another problem encountered during the hydrodesulphurization step is the formation of mercaptan type compounds resulting from the addition reaction of the $H_2S$ formed in the hydrodesulphurization reactor onto the monoolefins present in the gasoline feed. Mercaptans, with chemical formula R—SH, where R is an alkyl group, are also known as thiols or recombinant mercaptans and generally represent between 20% and 80% by weight of the residual sulphur in the desulphurized gasolines. In order to limit these disadvantages, various solutions have been described in the literature to desulphurize cracked gasolines with the aid of a combination of steps for hydrodesulphurization and elimination of recombinant mercaptans by a carefully selected technique so as to avoid hydrogenation of the monoolefins present in order to preserve the octane number (see, for example, U.S. Pat. Nos. 7,799,210, 6,960,291, 6,387,249 and US 2007/114156).

However, it appears that although these combinations using a final step for elimination of recombinant mercaptans are particularly suitable when a very low sulphur content is desired, they can prove to be very expensive when the quantity of mercaptans to be eliminated is high; in fact, this requires high adsorbent or solvent consumptions, for example.

Some of the solutions proposed in the literature for the production of gasolines with a reduced sulphur content propose the separation by distillation of full range cracked naphtha (or FRCN) obtained from cracking processes. In some patents (for example the patents EP 1 077 247, EP 1 174 485, U.S. Pat. Nos. 6,596,157, 6,913,688), distillation is intended to obtain 2 cuts: a light cut (LCN) and a heavy cut (HCN, or Heavy Cracked Naphtha). The FRCN gasoline may be treated upstream of the distillation, for example using a process that can allow selective hydrogenation of the diolefins of the gasoline and/or to allow the molecular weight of the light sulphur-containing compounds to be increased, in a manner such that after the distillation operation, these sulphur-containing compounds are recovered in the heavy cut, HCN. The sulphur-containing compounds of the heavy cut are then eliminated from the gasoline by various processes, for example via a catalytic hydrodesulphurization carried out with one or more reactors.

Other solutions employ separation by distillation of the full range naphtha cut FRCN into more than two cuts in order to produce a gasoline with a reduced sulphur content or even with very low sulphur contents, of the order of 10 ppm by weight. In this type of process, the cuts obtained are treated separately or partially combined to eliminate organic sulphur from at least a portion of the cuts obtained, the aim being to obtain a desulphurized gasoline after mixing all or at least a portion of the treated cuts.

As an example, patent application US2004/188327 describes a process that can be used to reduce the sulphur content of a FCC gasoline by separating the FRCN gasoline into three cuts by means of a distillation operation: a light cut, an intermediate cut and a heavy cut. The heavy cut is desulphurized and the effluent is combined with the intermediate cut, and then it is desulphurized in its entirety during a second hydrodesulphurization step. It is specified that the mercaptans contained in the light cut may be eliminated either by thioetherification upstream of the separation into three cuts, or by a caustic downstream treatment.

The patent U.S. Pat. No. 6,103,105 describes a similar process, the FRCN gasoline also being separated into three cuts by means of a distillation operation. It is specified that the light cut represents between 50% and 80% of the gasoline and that the heavy cut represents 5% to 20% of the FRCN gasoline. It is also specified that the intermediate cut and the heavy cut are hydrodesulphurized in a single reactor containing two catalytic beds. The heavy cut is treated in the first catalytic bed and the intermediate cut is added between the two beds so as to carry out a co-treatment with the partially desulphurized heavy cut obtained from the first bed in the second catalytic bed. The authors indicate that elimination of the sulphur is almost complete and also that hydrogenation of the olefins of the heavy cut is almost complete.

The patent FR 2 807 061 also describes a process for the desulphurization of gasoline comprising a selective hydrogenation step followed by separation into at least three fractions. The lightest fraction is practically free of sulphur. The heaviest fraction is treated at least once in order to desulphurize it of the unsaturated sulphur-containing compounds in the cut. The intermediate fraction is characterized by an olefins and aromatics content which is relatively low. Part or all of that cut undergoes at least one desulphurization and denitrogenation step followed by a catalytic reforming step.

The patent U.S. Pat. No. 9,260,672 describes a process for the production of gasoline with a small loss of octane number. In accordance with the inventors, after saturation of the diolefins, the FRCN gasoline is separated by distillation into a light cut with an end point of 70° C., an intermediate cut (70-90° C.) and a heavy cut (90-210° C.). The mercaptans of the light cut are eliminated with a caustic treatment in equipment known as CFC equipment (for Continuous Film Contactor). The heavy cut, principally containing thiophene sulphur-containing compounds, is desulphurized by a catalytic hydrodesulphurization or reactive adsorption process. The intermediate cut may be sent to the isomerization unit or catalytic reforming unit. Optionally, the intermediate cut may be co-treated with the light cut in CFC equipment in order to reduce the mercaptans content, or in fact this cut may be co-treated with the heavy cut. That process does not propose a separate desulphurization treatment for the intermediate cut.

The document US 2004/0195151 discloses a process for the selective desulphurization of FRCN gasoline. The FRCN gasoline is introduced into a reactive distillation column in order to both carry out a thioetherification treatment of the mercaptans contained in the feed and separation into a light cut, an intermediate cut and a heavy cut. The intermediate cut is withdrawn as a side stream and is treated in a desulphurization reactor.

The document US 2014/0054198 describes a process for reducing the sulphur content of a stream of hydrocarbons, the process comprising bringing a FRCN gasoline into contact with a hydrogenation catalyst in order to hydrogenate at least a portion of the dienes and convert at least a portion of the mercaptans into thioethers. This FRCN gasoline is then fractionated into a light fraction, an intermediate fraction and a heavy fraction. The heavy fraction is desulphurized in a catalytic hydrodesulphurization process. The intermediate fraction is mixed with hydrogen and a gas oil cut in order to form a mixture which is brought into contact with a catalyst in a hydrodesulphurization reactor then separated in order to obtain the desulphurized intermediate fraction and to recover the gas oil cut which is recycled to the process and optionally purged. In that process, hydrodesulphurization of the intermediate fraction is systematically carried out as a mixture with the gas oil cut or a portion of the heavy fraction in order to be able to use trickle bed reactor type technology or reactive distillation (which then enables hydrodesulphurization and separation to be carried out in a single step). Hydrodesulphurization of the intermediate fraction is thus carried out in a three-phase gas/liquid/solid medium. Using a gas oil cut mixed with the intermediate fraction, however, generally necessitates the use of a larger quantity of catalyst than in the case in which the intermediate fraction is treated alone, because the stream to be treated is more substantial.

One aim of the present invention is to propose a process for the desulphurization of an olefinic gasoline which, by limiting the loss of octane number, is capable of producing a gasoline with a low total sulphur content, typically less than 30 ppm, or in fact preferably less than 15 ppm by weight and also with a low (recombinant) mercaptans content, i.e. typically less than 15 ppm by weight (expressed as sulphur), or in fact preferably less than 5 ppm by weight (expressed as sulphur).

SUMMARY OF THE INVENTION

The present invention concerns a process for the treatment of a gasoline containing sulphur-containing compounds, olefins and diolefins, the process comprising the following steps:

a) fractionating the gasoline in a manner such as to recover at least one intermediate gasoline cut, MCN, comprising hydrocarbons and wherein the temperature difference ($\Delta T$) between the 5% and 95% by weight distillation points is less than or equal to 60° C.;

b) desulphurizing the intermediate gasoline cut MCN alone and in the presence of a hydrodesulphurization catalyst and hydrogen, at a temperature in the range 160° C. to 450° C., at a pressure in the range 0.5 to 8 MPa, with a liquid space velocity in the range 0.5 to 20 $h^{-1}$ and with a ratio between the flow rate of hydrogen, expressed in normal $m^3$ per hour, and the flow rate of feed to be treated, expressed in $m^3$ per hour under standard conditions, in the range 50 $Nm^3/m^3$ to 1000 $Nm^3/m^3$ in a manner such as to produce an at least partially desulphurized intermediate cut, MCN; and c) fractionating, in a splitter, the partially desulphurized intermediate gasoline cut MCN which has not undergone catalytic treatment subsequent to step b), in a manner such as to recover an intermediate gasoline with low sulphur and mercaptans contents from the column head and a cut of hydrocarbons containing sulphur-containing compounds including mercaptans from the column bottom.

Because of the combination of the successive steps a), b) and c), the process in accordance with the invention can be used to produce an intermediate gasoline with a low sulphur and mercaptans content and a high octane number. In fact, the fractionation step a) is operated under specific conditions in order to separate an intermediate gasoline cut MCN boiling in a narrow temperature range, i.e. the temperature difference (ΔT) between the 5% and 95% by weight distillation points (measured in accordance with the CSD method described in the document Oil Gas Sci. Technol. Vol. 54 (1999), No. 4, pp. 431-438) is less than or equal to 60° C.

Preferably, the intermediate MCN cut obtained from step a) has a temperature difference (ΔT) between the temperatures corresponding to 5% and 95% of the distilled weight (measured in accordance with the CSD method described in the document Oil Gas Sci. Technol. Vol. 54 (1999), No. 4, pp. 431-438), which is in the range 20° C. to 60° C. and more preferably in the range 25 and 40° C.

Said intermediate gasoline cut MCN alone, i.e. without being mixed with any cut of hydrocarbons internal or external to the process, is then treated in a hydrodesulphurization step (step b) in order to convert the sulphur-containing compounds into hydrogen sulphide, $H_2S$, and under conditions that can be used to limit hydrogenation of the olefins and thus the loss of octane number. During this step b), mercaptans known as "recombinant" mercaptans are formed by reaction between the olefins of the intermediate cut, MCN, and $H_2S$. These recombinant mercaptans, which have higher boiling points than those of the olefins from which they are obtained, are then separated from the intermediate gasoline cut MCN, which has been partially desulphurized, during step c). In the context of the invention, the process may comprise a step for degassing $H_2S$ present in the effluent obtained from step b), which may be carried out before, during or after step c). Step c) for separating the recombinant mercaptans is generally carried out using a splitter which provides a bottom cut charged with mercaptans and an overhead cut (intermediate gasoline) with low sulphur and mercaptans contents, i.e. with a total sulphur content which is typically less than 30 ppm by weight, or in fact preferably less than 15 ppm by weight. In the case in which the effluent from step b) has not undergone the degassing step to separate the hydrogen and the hydrogen sulphide (stabilization of the gasoline) before the fractionation of step c), the hydrogen and hydrogen sulphide may be separated overhead from the splitter c) operated in a manner such that the operations for stabilization and separation of the mercaptans are then carried out in the same column and the intermediate gasoline with low sulphur and mercaptans contents is then obtained by withdrawal as a side stream located close to, typically a few theoretical plates below, the head of that same column. Finally, in the case in which the effluent from step b) is not stabilized either upstream of step c) nor during step c), the stabilization operation may be carried out downstream, on the stream of intermediate gasoline with low sulphur and mercaptans contents. The fractionation of step c) is preferably operated in a manner such that the intermediate gasoline overhead has a temperature difference (ΔT) between the 5% and 95% by weight distillation points (measured in accordance with the CSD method described in the document Oil Gas Sci. Technol. Vol. 54 (1999), No. 4, pp. 431-438), which is equal to the temperature difference (ΔT) between the 5% and 95% by weight distillation points of the intermediate gasoline cut MCN obtained from step a). Alternatively, step c) is operated in a manner such that the overhead cut (intermediate gasoline with low sulphur and mercaptans contents) has a temperature corresponding to 95% of the distilled weight which is lower by a maximum of 10° C. compared with the temperature corresponding to 95% of the distilled weight of the intermediate MCN cut obtained from step a).

When step c) is carried out in a separation (or fractionation) column, the stream for the bottom cut which is withdrawn either continuously or discontinuously may subsequently be treated by hydrodesulphurization in a mixture with a heavy HHCN gasoline, which is heavier than the intermediate gasoline cut MCN.

The process in accordance with the invention has the advantage of producing an intermediate gasoline with low sulphur and mercaptans contents without any substantial loss of octane number, because the recombinant mercaptans which are inevitably formed in the desulphurization step b) are not converted by a subsequent hydrodesulphurization step but are separated from the partially desulphurized intermediate gasoline cut in a carefully selected fractionation step.

Preferably, the intermediate gasoline cut MCN obtained from step a) has temperatures corresponding to 5% and 95% of the distilled weight (measured in accordance with the CSD method described in the document Oil Gas Sci. Technol. Vol. 54 (1999), No. 4, pp. 431-438), which are respectively in the range 50° C. to 68° C. and in the range 88° C. to 110° C.

In accordance with a preferred embodiment, the process comprises the following steps:

a) fractionating the gasoline into at least:

a light gasoline cut LCN;

an intermediate gasoline cut, MCN, comprising hydrocarbons and wherein the temperature difference (ΔT) between the 5% and 95% by weight distillation points is less than or equal to 60° C.; and a heavy gasoline cut HHCN containing hydrocarbons;

b) desulphurizing the intermediate gasoline cut MCN alone and in the presence of a hydrodesulphurization catalyst and hydrogen, at a temperature in the range 160° C. to 450° C., at a pressure in the range 0.5 to 8 MPa, with a liquid space velocity in the range 0.5 to 20 $h^{-1}$ and with a ratio between the flow rate of hydrogen, expressed in normal $m^3$ per hour, and the flow rate of feed to be treated, expressed in $m^3$ per hour under standard conditions, in the range 50 $Nm^3/m^3$ to 1000 $Nm^3/m^3$ in a manner such as to produce an at least partially desulphurized intermediate gasoline cut MCN;

c) fractionating, in a splitter, the partially desulphurized intermediate gasoline cut MCN which has not undergone catalytic treatment subsequent to step b), in a manner such as to recover an intermediate gasoline with low sulphur and mercaptans contents from the column head and a cut of hydrocarbons containing sulphur-containing compounds including mercaptans from the column bottom;

d) desulphurizing the heavy gasoline cut HHCN alone or as a mixture with the bottom cut of hydrocarbons obtained from step c) in the presence of a hydrodesulphurization catalyst and hydrogen, at a temperature in the range 200° C. to 400° C., at a pressure in the range 0.5 to 8 MPa, with a liquid space velocity in the range 0.5 to 20 $h^{-1}$ and with a ratio between the flow rate of hydrogen, expressed in normal $m^3$ per hour, and the flow rate of feed to be treated, expressed in $m^3$ per hour under standard conditions, in the range 50 $Nm^3/m^3$ to 1000 $Nm^3/m^3$ in a manner such as to produce an at least partially desulphurized heavy HHCN cut.

In this embodiment, step a) may be carried out in two fractionation steps, i.e.:

a1) fractionating the gasoline into a light gasoline cut LCN and an intermediate heavy gasoline cut HCN;

a2) fractionating the intermediate heavy gasoline cut HCN into at least one intermediate gasoline cut MCN and a heavy gasoline cut HHCN.

In this particular embodiment, it is also possible to desulphurize the intermediate heavy gasoline cut HCN obtained from step a1) before the fractionation step a2).

Alternatively, step a) is carried out in a single fractionation step. Preferably, this step is carried out in a divided wall column.

In one embodiment, step a2) is carried out in a divided wall column and the partially desulphurized intermediate gasoline cut MCN obtained from step b) is sent to said divided wall column for fractionation.

In accordance with a particular embodiment, the light gasoline cut LCN has a final boiling temperature of 65° C.±2° C., the intermediate gasoline cut MCN has a final boiling temperature of less than or equal to 100° C.±2° C. and the heavy gasoline cut HHCN has an initial boiling temperature of more than 100° C.±2° C.

In accordance with the invention, step d) employs at least one hydrodesulphurization reactor. Preferably, step d) employs a first and a second hydrodesulphurization reactor disposed in series. Preferably, the effluent obtained from the first hydrodesulphurization reactor undergoes a degassing step for the $H_2S$ formed before being treated in the second hydrodesulphurization reactor.

The hydrodesulphurization catalysts of steps b) and/or d) comprise at least one element from group VIII (groups 8, 9 and 10 of the new periodic classification, Handbook of Chemistry and Physics, 76th edition, 1995-1996), at least one element from group VIb (group 6 of the new periodic classification, Handbook of Chemistry and Physics, 76th edition, 1995-1996) and a support.

In a particular embodiment, a portion of the desulphurized heavy gasoline cut HHCN obtained from step d) is recycled to step c) so as to encourage entrainment of the recombinant mercaptans at the bottom of the splitter. As an example, a portion of the desulphurized heavy gasoline cut HHCN obtained from step d) is mixed with the partially desulphurized intermediate gasoline cut MCN obtained from step b) and said mixture is fractionated in step c). Alternatively, a portion of the desulphurized heavy gasoline cut HHCN obtained from step d) is sent directly to the splitter of step c).

Before step a), the gasoline may be treated in the presence of hydrogen and a selective hydrogenation catalyst in order to at least partially hydrogenate the diolefins and to carry out a reaction for increasing the molecular weight of a portion of the sulphur-containing compounds, step a) being operated at a temperature in the range 50° C. to 250° C., at a pressure in the range 1 to 5 MPa, with a liquid space velocity in the range 0.5 to 20 $h^{-1}$ and with a ratio between the flow rate of hydrogen, expressed in normal $m^3$ per hour, and the flow rate of feed to be treated, expressed in $m^3$ per hour under standard conditions, in the range 2 $Nm^3/m^3$ to 100 $Nm^3/m^3$. In accordance with the invention, the catalyst for the hydrogenation step is a sulphurized catalyst comprising at least one element from group VIII (groups 8, 9 and 10 of the new periodic classification, Handbook of Chemistry and Physics, 76th edition, 1995-1996) and optionally at least one element from group VIb (group 6 of the new periodic classification, Handbook of Chemistry and Physics, 76th edition, 1995-1996) and a support.

BRIEF DESCRIPTION OF THE FIGURES

Other characteristics and advantages of the invention will become apparent from reading the following description, given solely by way of non-limiting illustration and made with reference to the following figures.

In general, similar elements are denoted by identical references in the figures.

Description of the Feed

Figure 1:
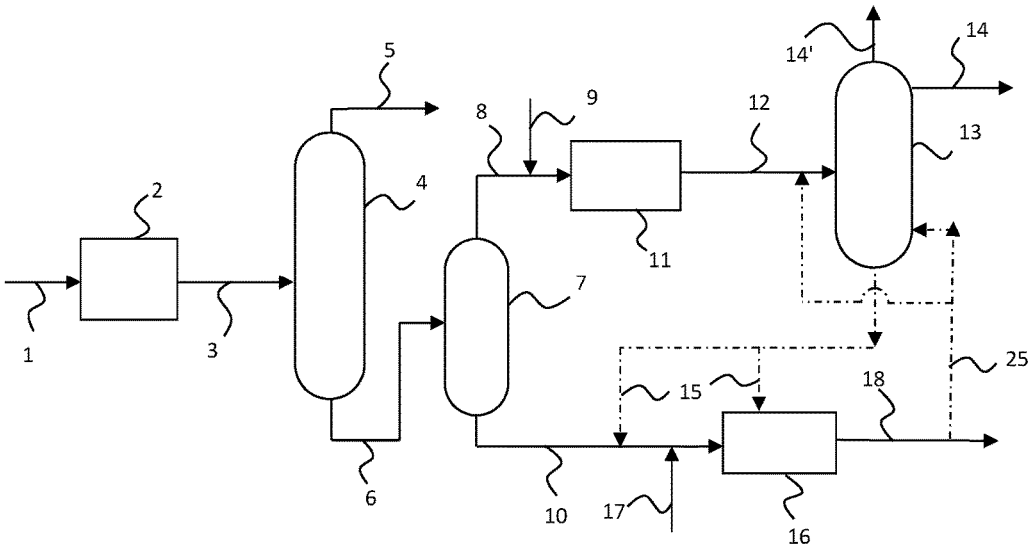
FIG. 1 is a flow chart of the process in accordance with the invention.

The process in accordance with the invention can be used to treat any type of olefinic gasoline cut containing sulphur, preferably a gasoline cut obtained from a catalytic or non-catalytic cracking unit, for which the boiling point range typically extends from approximately the boiling points of hydrocarbons containing 2 or 3 carbon atoms ($C_2$ or $C_3$) up to approximately 250° C., preferably from approximately the boiling points of hydrocarbons containing 2 or 3 carbon atoms ($C_2$ or $C_3$) to approximately 220° C., more preferably from approximately the boiling points of hydrocarbons containing 4 carbon atoms to approximately 220° C. The process in accordance with the invention may also be used to treat feeds with end points below those mentioned above such as, for example, a $C_5$-200° C. or $C_5$-160° C. cut.

The sulphur content of gasoline cuts produced by catalytic cracking (FCC) or non-catalytic cracking depends on the sulphur content of the treated feed, on the presence or absence of pre-treatment of the feed, and also on the end point of the cut. In general, the sulphur contents of the gasoline cut as a whole, in particular those from FCC, are more than 100 ppm by weight and the majority of the time more than 500 ppm by weight. For gasolines with end points of more than 200° C., the sulphur contents are often more than 1000 ppm by weight, and may even in some cases reach values of the order of 4000 to 5000 ppm by weight.

As an example, the gasolines obtained from catalytic cracking units (FCC) contain, on average, between 0.5% and 5% by weight of diolefins, between 20% and 50% by weight of olefins, and between 10 ppm and 0.5% by weight of sulphur, of which generally less than 300 ppm of mercaptans. The mercaptans are generally concentrated in the light fractions of the gasoline and more precisely in the fraction with a boiling point of less than 120° C.

The sulphur-containing species contained in the feeds treated by the process of the invention may be mercaptans or heterocyclic compounds such as, for example, thiophenes or alkylthiophenes, or heavier compounds such as benzothiophene, for example. In contrast to mercaptans, these heterocyclic compounds cannot be eliminated by extractive processes. These sulphur-containing compounds are consequently eliminated by a hydrotreatment which results in their transformation into hydrocarbons and $H_2S$.

Detailed Description of the Layout of the Invention

The present invention concerns a process for the treatment of a gasoline containing sulphur-containing compounds, olefins and diolefins, the process comprising the following steps:

a) fractionating the gasoline in a manner such as to recover at least one intermediate gasoline cut, MCN, comprising hydrocarbons and wherein the temperature difference (ΔT) between the 5% and 95% by weight distillation points is less than or equal to 60° C.; and b) desulphurizing the intermediate MCN cut alone and in the presence of a hydrodesulphurization catalyst and hydrogen, at a temperature in the range 160° C. to 450° C., at a pressure in the range 0.5 to 8 MPa, with a liquid space velocity in the range 0.5 to 20 $h^{-1}$ and with a ratio between the flow rate of hydrogen, expressed in normal $m^3$ per hour, and the flow rate of feed to be treated, expressed in $m^3$ per hour under standard conditions, in the range 50 $Nm^3/m^3$ to 1000 $Nm^3/m^3$ in a manner such as to produce an at least partially desulphurized intermediate cut, MCN;

c) fractionating, in a splitter, the at least partially desulphurized intermediate cut which has not undergone catalytic treatment subsequent to step b), in a manner such as to recover an intermediate gasoline with low sulphur and mercaptans contents from the column head and from the column bottom a hydrocarbon cut containing sulphur-containing compounds including mercaptans.

In order to obtain the intermediate gasoline cut MCN, the conditions in the splitter or columns are adjusted in a manner such as to obtain a hydrocarbon cut wherein the temperature difference (ΔT) between the temperatures corresponding to 5% and 95% of the distilled weight are less than or equal to 60° C., preferably in the range 20° C. to 60° C. and still more preferably in the range 25 to 40° C. The temperature corresponding to 5% of the distilled weight of the intermediate gasoline cut MCN is preferably in the range 50° C. to 68° C. and the temperature corresponding to 95% of the distilled weight of the intermediate gasoline cut MCN is preferably in the range 88° C. to 110° C. As an example, the intermediate gasoline cut MCN has a temperature corresponding to 5% of the distilled weight which is equal to 65° C.±2° C., preferably equal to 60° C.±2° C. and more preferably equal to 55° C.±2° C. Preferably, the intermediate gasoline cut MCN has a temperature corresponding to 95% of the distilled weight which is equal to 100° C.±2° C., or in fact equal to 90° C.±2° C. The method used to determine the temperatures corresponding to 5% and 95% of the distilled weight is described in the document Oil Gas Sci. Technol. Vol. 54 (1999), No. 4, pp. 431-438 under the heading "CSD method" (abbreviation for "Conventional Simulated Distillation").

In a preferred embodiment, the intermediate gasoline cut MCN essentially contains hydrocarbons containing 6 or 7 carbon atoms, and mainly hydrocarbons containing 6 carbon atoms.

In accordance with a preferred embodiment of the treatment process, the fractionation step a) is carried out in a manner such as to separate three cuts:

a light gasoline cut LCN;

an intermediate gasoline cut MCN; and a heavy gasoline cut HHCN.

Fractionation of the gasoline into three cuts may be carried out in a single fractionation step or in several fractionation steps. If the fractionation is carried out in a single step with a single column, said distillation column is preferably a divided wall column. In the case in which fractionation is carried out with two splitters, separation is preferably carried out in a manner such that two cuts are withdrawn from the first column—the light gasoline cut, LCN, overhead and an intermediate heavy cut, HCN, from the bottom, the intermediate heavy cut HCN then being fractionated in the second splitter in order to obtain the intermediate gasoline cut MCN overhead and the heavy gasoline cut HHCN from the bottom.

The cut point between the LCN and MCN or HCN gasolines is preferably adjusted in a manner such as to produce a light gasoline cut LCN with a sulphur content which is typically a maximum of 15 ppm or 10 ppm by weight. Thus, the cut point between the LCN or MCN gasoline cuts could be in the range 50° C. to 68° C. and preferably in the range 50° C. to 65° C. In a preferred embodiment, the light LCN cut is a $C_5^-$ hydrocarbon cut; i.e. containing a maximum of 5 carbon atoms.

In accordance with a preferred embodiment, the heavy gasoline cut HHCN withdrawn from the bottom of the splitter, or from the bottom of the second splitter if two columns are used to carry out fractionation into three cuts, generally contains hydrocarbons containing 7 and more than 7 carbon atoms.

In accordance with step b) of the process in accordance with the invention, the intermediate gasoline cut MCN is desulphurized alone (i.e. without being mixed with any other hydrocarbon cut) in the presence of a hydrodesulphurization catalyst and hydrogen at a temperature in the range 160° C. to 450° C., at a pressure in the range 0.5 to 8 MPa, with a liquid space velocity in the range 0.5 to 20 $h^{-1}$ and with a ratio between the flow rate of hydrogen, expressed in normal $m^3$ per hour, and the flow rate of feed to be treated, expressed in $m^3$ per hour under standard conditions, in the range 50 $Nm^3/m^3$ to 1000 $Nm^3/m^3$ in order to convert the sulphur-containing products into $H_2S$.

This hydrodesulphurization step is primarily aimed at converting the mercaptan, sulphide and thiophene type compounds present in the intermediate gasoline cut MCN into $H_2S$.

During this step b), the reaction for the formation of recombinant mercaptans by addition of the $H_2S$ formed to the olefins has also taken place. In general, the recombinant mercaptans have boiling points which are higher than those of the olefins from which they are obtained. As an example, 2-methyl-2-pentene (boiling point when pure under normal conditions: 67° C.) can form a recombinant mercaptan containing 5 carbon atoms such as 2-methyl-2-penthanethiol (boiling point when pure under normal conditions: 125° C.).

This property is used to separate the recombinant mercaptans from the partially desulphurized intermediate MCN cut in accordance with step c) of the process. In accordance with step c) of the process, after the hydrodesulphurization step b), the intermediate cut MCN is sent to a separation unit comprising at least one splitter which is designed and operated in a manner such as to provide an intermediate gasoline MCN with low sulphur contents overhead from the fractionation unit, i.e. typically less than 30 ppm by weight of sulphur and preferably less than 15 ppm by weight of sulphur, and with a low mercaptans content (preferably less than 15 ppm by weight, expressed as sulphur). In order to recover the mercaptans from the bottom of the splitter, this column is preferably operated in accordance with two modes:

either a cut which is heavier than the intermediate gasoline cut MCN such as, for example, a portion of the desulphurized HHCN gasoline recovered from step d) described below, is mixed with the gasoline obtained from step b) and the mixture is fractionated in step c). Alternatively, the heavy cut is sent to the splitter of step c) to a level located below the injection point for the partially desulphurized intermediate gasoline cut MCN, or the column is operated with total reflux at the bottom and with discontinuous withdrawal of the bottom cut containing the mercaptans (the column is then known as a rerun column).

In both cases, the stream containing the (recombinant) mercaptans withdrawn from the bottom of the column, continuously or discontinuously, may advantageously be treated by hydrodesulphurization as a mixture with the heavy gasoline HHCN.

In accordance with the invention, step c) is carried out in a manner such that the overhead intermediate gasoline with low sulphur and mercaptans contents substantially has the same narrow distillation range as that of the intermediate gasoline cut MCN before the desulphurization step b), in a manner such that the recombinant mercaptans, for which the boiling points are higher than those of the olefins from which they are obtained, are entrained in the bottom of the distillation column. Thus, the intermediate overhead gasoline with low sulphur and mercaptans contents preferably has a temperature difference (ΔT) (temperature difference corresponding to 5% and 95% of the distilled weight (determined in accordance with the CSD method described in the document Oil Gas Sci. Technol. Vol. 54 (1999), No. 4, pp. 431-438) which is equal to the temperature difference (ΔT) of the intermediate gasoline cut MCN of step a). Alternatively, the overhead cut has a temperature corresponding to 95% of the distilled weight (determined in accordance with the CSD method described in the document Oil Gas Sci. Technol. Vol. 54 (1999), No. 4, pp. 431-438) which is lower by a maximum of 10° C. with respect to the temperature corresponding to 95% of the distilled weight of the intermediate gasoline cut MCN of step a).

The process in accordance with the invention may comprise a step for degassing the $H_2S$ and hydrogen (also designated by the term "stabilization step") present in the effluent obtained from step b) which may be carried out before, during or after step c). In the case in which the effluent from step b) has not undergone a degassing step to separate the hydrogen and hydrogen sulphide before the fractionation of step c), these may be separated from the head of the splitter c) which is operated in a manner such that the stabilization and mercaptans separation operations are then carried out simultaneously in the same column and in a manner such that the intermediate gasoline with low sulphur and mercaptans contents is obtained as a side stream from close to the head of that same column, typically several theoretical plates lower down.

In a preferred embodiment, when step a) produces three hydrocarbon cuts, including a heavy HHCN cut, the heavy gasoline cut HHCN is desulphurized (step d) alone or as a mixture with the bottom withdrawal from the splitter described in step c). The desulphurization of the HHCN cut (alone or as a mixture) may be carried out with one or two reactors in series. If the desulphurization is carried out with a single reactor, this is operated in a manner such as to obtain a desulphurized heavy HHCN gasoline with a sulphur content which is typically less than or equal to 30 ppm by weight and preferably less than or equal to 15 ppm by weight.

The desulphurization may also be carried out with two reactors in series, with or without an intermediate step for degassing the $H_2S$ formed in the first reactor. The reactors are operated in a manner such as to obtain, after the second reactor, a desulphurized HHCN gasoline with a sulphur content which is typically less than 30 ppm by weight and preferably less than or equal to 15 ppm by weight. Desulphurization of the heavy gasoline (alone or as a mixture with the bottom cut recovered from step c)) in one or two reactors in series, with or without an intermediate step for degassing the $H_2S$, is carried out in the presence of one or more hydrodesulphurization catalysts and hydrogen, at a temperature in the range 200° C. to 400° C., at a pressure in the range 0.5 to 8 MPa, with a liquid space velocity in the range 0.5 to 20 $h^{-1}$ and with a ratio between the flow rate of hydrogen, expressed in normal $m^3$ per hour, and the flow rate of feed to be treated, expressed in $m^3$ per hour under standard conditions, in the range 50 $Nm^3/m^3$ to 1000 $Nm^3/m^3$.

Referring now to FIG. 1, which represents a particular embodiment of the invention, an olefinic gasoline feed, for example a catalytically cracked gasoline described above, is treated in an optional step which carries out the selective hydrogenation of the diolefins and the conversion (molecular weight increase) of a portion of the mercaptan compounds (RSH) present in the feed into thioethers, by reaction with the olefins. Typically, the mercaptans which may react during the optional selective hydrogenation step are the following (non-exhaustive list): methyl mercaptan, ethyl mercaptan, n-propyl mercaptan, iso-propyl mercaptan, iso-butyl mercaptan, tert-butyl mercaptan, n-butyl mercaptan, sec-butyl mercaptan, iso-amyl mercaptan, n-amyl mercaptan, α-methylbutyl mercaptan, α-ethylpropyl mercaptan, n-hexyl mercaptan, and 2-mercapto-hexane.

To this end, the FRCN gasoline feed is sent, via the line 1, to a selective hydrogenation catalytic reactor 2 containing at least one fixed or moving bed of catalyst for the selective hydrogenation of diolefins and for increasing the molecular weight of the mercaptans.

The reaction for the selective hydrogenation of diolefins and for increasing the molecular weight of the mercaptans is preferably carried out on a sulphurized catalyst comprising at least one element from group VIII (groups 8, 9 and 10 of the new periodic classification, Handbook of Chemistry and Physics, 76th edition, 1995-1996) and optionally at least one element from group VIb (group 6 of the new periodic classification, Handbook of Chemistry and Physics, 76th edition, 1995-1996) and a support. The element from group VIII is preferably selected from nickel and cobalt, and in particular nickel. The element from group VIb, when it is present, is preferably selected from molybdenum and tungsten; highly preferably, it is molybdenum.

The catalyst support is preferably selected from alumina, nickel aluminate, silica, silicon carbide or a mixture of these oxides. Preferably, alumina is used, and more preferably, high purity alumina.

In accordance with a preferred embodiment, the selective hydrogenation catalyst contains nickel in a content by weight of nickel oxide (in the form of NiO) in the range 4% to 12%, and molybdenum in an amount, as the amount by weight of molybdenum oxide (in the form of $MoO_3$), in the range 6% to 18%, and a nickel/molybdenum molar ratio in the range 1 to 2.5, the metals being deposited on a support constituted by alumina and wherein the degree of sulphurization of the metals constituting the catalyst is more than 80%.

During the optional selective hydrogenation step, the gasoline to be treated is typically brought into contact with the catalyst at a temperature in the range 50° C. to 250° C., and preferably in the range 80° C. to 220° C., and yet more preferably in the range 90° C. to 200° C., with a liquid space velocity (LHSV) in the range 0.5 $h^{-1}$ to 20 $h^{-1}$, the unit for the liquid space velocity being a liter of feed per liter of catalyst and per hour (l/l.h). The pressure is in the range 0.4 MPa to 5 MPa, preferably in the range 0.6 to 4 MPa and yet more preferably in the range 1 to 2 MPa. The optional selective hydrogenation step is typically carried out with a $H_2$/HC ratio in the range 2 to 100 $Nm^3$ of hydrogen per $m^3$ of feed, preferably in the range 3 to 30 $Nm^3$ of hydrogen per $m^3$ of feed.

The whole of the feed is generally injected into the inlet to the reactor. However, it may in some cases be advantageous to inject a fraction or all of the feed between two consecutive catalytic beds placed in the reactor. This embodiment means that, in particular, the reactor can continue to be operated if the inlet to the reactor becomes blocked by deposits of polymers, particles or gums present in the feed.

Referring to the example of FIG. 1, an effluent with low diolefins and mercaptans contents is withdrawn from the reactor 2 via the line 3 and is sent, in accordance with step a), into a splitter 4 configured in order to separate the gasoline into two cuts: a light gasoline cut LCN (or light gasoline) and an intermediate heavy cut (or intermediate heavy gasoline) HCN, which is constituted by the heavy fraction which is complementary to the light gasoline. The final boiling point of the light cut is selected in a manner such as to provide a light gasoline cut with a low sulphur content (total sulphur content typically less than 30 ppm by weight and preferably less than 10 ppm by weight) without necessitating a subsequent hydrodesulphurization step. Thus, preferably, the light gasoline cut LCN is a $C_5^-$hydrocarbon cut (i.e. containing hydrocarbons containing 5 and fewer than 5 carbon atoms per molecule).

In step a) of the process, the intermediate heavy gasoline cut HCN 6, which is preferably a $C6^+$cut (i.e. containing hydrocarbons which may contain 6 and more than 6 carbon atoms per molecule) is sent to a splitter 7 configured in order to separate an intermediate gasoline cut MCN characterized by a narrow distillation range, i.e. in which the difference in temperatures corresponding to 5% and to 95% of the distilled weight (determined in accordance with the "CSD" simulated distillation method described in the document Oil Gas Sci. Technol. Vol. 54 (1999), No. 4, pp. 431-438) is less than or equal to 60° C., preferably in the range 20° C. to 60° C. and yet more preferably in the range 25° C. to 40° C. In a preferred embodiment, the temperature corresponding to 5% of the distilled weight of the intermediate gasoline cut MCN is in the range 50° C. to 68° C., and the temperature corresponding to 95% of the distilled weight of the intermediate gasoline cut MCN is in the range 88° C. to 110° C. The intermediate gasoline cut MCN has, for example, temperatures corresponding to 5% and 95% of the distilled weight of respectively 60° C. and 100° C., or in fact of respectively 65° C. and 100° C. or in fact of respectively 55° C. and 90° C. The intermediate gasoline cut MCN may contain hydrocarbons containing 5 to 7 carbon atoms, and primarily hydrocarbons containing 6 carbon atoms.

As can be seen in FIG. 1, the intermediate gasoline cut MCN is withdrawn via the line 8, while the complementary heavy bottom cut, denoted HHCN, is extracted from the splitter 7 via the line 10.

The overhead cut 8 (intermediate gasoline cut MCN) still contains sulphur-containing compounds of the mercaptan, sulphide and thiophene types. Depending on the cut points selected and by way of example, these sulphur-containing compounds may be:

2-methyl-2-propanethiol (normal boiling temperature=64° C.), methyl-ethyl-sulphide (normal boiling temperature=67° C.), propanethiol (normal boiling temperature=68° C.), thiophene (normal boiling temperature=84° C.), 2 methyl-1-propanethiol (normal boiling temperature=88° C.)

Diethyl sulphide (normal boiling temperature=92° C.), thiacyclobutane (normal boiling temperature=95° C.), 1-butanethiol (normal boiling temperature=98° C.), 2 methyl-2-butanethiol (normal boiling temperature=99° C.)

In accordance with the invention, the overhead cut 8 (intermediate MCN cut) is treated in a selective hydrodesulphurization (selective HDS) step b). This step is intended to convert the sulphur-containing compounds of the intermediate gasoline cut MCN into $H_2S$ and hydrocarbons using a catalyst as described below and hydrogen.

The hydrocarbon cut 8 (intermediate gasoline cut MCN) is brought into contact with hydrogen supplied via the line 9 and a selective HDS catalyst in at least one hydrodesulphurization unit 11 which comprises at least one reactor with a fixed or moving bed of catalyst. The hydrodesulphurization reaction is generally carried out at a temperature in the range 160° C. to 450° C., at a pressure in the range 0.5 to 8 MPa. The liquid space velocity is generally in the range 0.5 to 20 $h^{-1}$ (expressed as the volume of liquid per volume of catalyst per hour), preferably in the range 1 to 8 $h^{-1}$. The ratio of the $H_2$/intermediate gasoline cut, MCN, is adjusted as a function of the desired degrees of hydrodesulphurization to be in the range 50 to 1000 normal $m^3$ per $m^3$ under standard conditions. Preferably, the mixture of the intermediate gasoline cut MCN with the hydrogen brought into contact with the catalyst in step b) is wholly in the vapour phase. Preferably, the temperature is in the range 200° C. to 400° C., and more preferably in the range 200° C. to 350° C. Preferably, the pressure is in the range 1 to 3 MPa.

The selective HDS catalyst employed in the sulphurized form comprises at least one element from group VIII (groups 8, 9 and 10 of the new periodic classification, Handbook of Chemistry and Physics, 76th edition, 1995-1996), at least one element from group VIb (group 6 of the new periodic classification, Handbook of Chemistry and Physics, 76th edition, 1995-1996) and a support. The element from group VIII is preferably selected from nickel and cobalt, and in particular is cobalt. The element from group VIb is preferably selected from molybdenum and tungsten, and yet more preferably is molybdenum. The catalyst may, for example, be a catalyst as described in the patents FR 2 840 315, FR 2 840 316, FR 2 904 242 or FR 3 023 184.

The support for the catalyst is preferably selected from alumina, nickel aluminate, silica, silicon carbide, or a mixture of these oxides. Preferably, alumina is used.

It should be noted that the hydrogen supplied via the line 9 may be makeup hydrogen or recycle hydrogen originating from a step of the process, in particular from step d). Preferably, the hydrogen of line 9 is makeup hydrogen.

The hydrodesulphurization step b) generates hydrogen sulphide ($H_2S$) in the reactor 11 which reacts with the olefins of the intermediate cut MCN in order to form mercaptans known as recombinant mercaptans which, when they are not eliminated, are responsible for the presence of residual sulphur in the partially desulphurized intermediate cut, MCN. This reduction in the recombinant mercaptans content could be carried out by catalytic hydrodesulphurization using a supplemental reactor or by employing a second catalytic bed, but at the price of hydrogenation of the monoolefins present in the intermediate cut MCN, which would then have the consequence of a substantial reduction in the octane number of said cut as well as an excess hydrogen consumption.

In accordance with step c) of the process in accordance with the invention, the effluent obtained from step b) is sent to a splitter 13 designed and operated in order to separate at the head of the column an intermediate gasoline 14 with a low sulphur content and a low (recombinant) overhead, i.e. with a sulphur content typically less than 30 ppm by weight and a mercaptans content typically less than 15 ppm by weight, and a bottom cut 15 which contains sulphur-containing compounds of the mercaptans type generated during step b) and for which the boiling point is higher than the final boiling point of the intermediate gasoline cut MCN obtained from the fractionation step a).

Preferably, the overhead cut 14 withdrawn from the column 13 has a narrow distillation range corresponding to that of the intermediate gasoline cut MCN recovered in step a), i.e. characterized by a temperature difference (ΔT) (difference between the temperatures corresponding to 5% and 95% of the distilled weight determined in accordance with the "CSD" simulated distillation method described in the document Oil Gas Sci. Technol. Vol. 54 (1999), No. 4, pp. 431-438) which is substantially equal to the temperature difference (ΔT) of the intermediate gasoline cut MCN obtained from step a).

In accordance with another embodiment, the overhead cut withdrawn from the head of the column 13 is characterized by a temperature corresponding to 95% of the distilled weight (determined in accordance with the "CSD" simulated distillation method described in the document Oil Gas Sci. Technol. Vol. 54 (1999), No. 4, pp. 431-438) which is lower by a maximum of 10° C. with respect to the temperature corresponding to 95% of the distilled weight of the intermediate gasoline cut MCN obtained from step a).

Thus, when the overhead cut has a temperature difference (ΔT) which is substantially equal to or lower than that of the MCN cut from which it is obtained, said overhead cut contains a very small recombinant mercaptans content because, since they generally have a boiling temperature which is higher than the final temperature of the overhead cut, they are entrained in the bottom cut.

As indicated in FIG. 1, step c) may be carried out by using a column known as a rerun column which is operated with total reflux at the bottom and with discontinuous withdrawal of the bottom cut 15 containing the recombinant mercaptans. It should also be noted that in the example of FIG. 1, the splitter 13 is designed and operated in order to carry out concomitant degassing of the $H_2$ (unreacted) and $H_2S$ which are withdrawn (via the line 14') via the head of the splitter and the separation of intermediate gasoline with low sulphur and mercaptans contents 14 which is withdrawn as a side stream located close to, typically a few theoretical plates below, the head of this same column.

Alternatively, as also represented in FIG. 1, a heavier cut than the intermediate gasoline cut MCN may also be used in step c) in order to facilitate entrainment of the recombinant mercaptans at the column bottom. This heavier cut 25 may either be mixed with the partially desulphurized intermediate cut obtained from step b), or be injected directly into the column 13 below the inlet point for the partially desulphurized cut 12. Preferably, the heavier cut will be a portion of the desulphurized HHCN cut, stabilized or otherwise, recycled via the line 25.

The stream withdrawn from the bottom of the column 13 (via the line 15) may either be supplied directly to the reactor 16 of the selective hydrodesulphurization unit, or be mixed with the HHCN cut (obtained from step a), with the mixture being sent to the selective hydrodesulphurization unit. When the stream withdrawn from the bottom of the column 13 is sent directly to the hydrodesulphurization reactor, it may be injected between two catalytic beds of the reactor 16 in a manner such that is it used as a quench fluid. This selective hydrodesulphurization step d) may thus be used to convert the sulphur-containing compounds of the HHCN cut and the recombinant mercaptans formed in the hydrodesulphurization step b) into $H_2S$ and hydrocarbons. The selective hydrodesulphurization step d) is operated in the presence of hydrogen supplied via the line 17 and a selective hydrodesulphurization catalyst which comprises at least one element from group VIII (groups 8, 9 and 10 of the new periodic classification, Handbook of Chemistry and Physics, 76th edition, 1995-1996), at least one element from group VIb (group 6 of the new periodic classification, Handbook of Chemistry and Physics, 76th edition, 1995-1996) and a support. The element from group VIII is preferably selected from nickel and cobalt, and in particular is cobalt. The element from group VIb is preferably selected from molybdenum and tungsten, and highly preferably is molybdenum. The catalyst may, for example, be a catalyst as described in the patents FR 2 840 315, FR 2 840 316, FR 2 904 242 or FR 3 023 184.

The hydrodesulphurization reaction is generally carried out at a temperature in the range 200° C. to 450° C., at a pressure in the range 0.5 to 8 MPa. The liquid space velocity is generally in the range 0.5 to 20 $h^{-1}$ (expressed as the volume of liquid per volume of catalyst per hour), preferably in the range 1 to 8 $h^{-1}$. The $H_2$/HHCN cut ratio which is adjusted as a function of the desired degrees of hydrodesulphurization is in the range 50 to 1000 normal $m^3$ per $m^3$ under standard conditions.

Preferably, the temperature is in the range 200° C. to 400° C., and highly preferably in the range 200° C. to 350° C. Preferably, the pressure is in the range 0.5 to 3 MPa.

At the end of step d), a desulphurized hydrocarbon cut HHCN is withdrawn from the selective hydrodesulphurization unit via the line 18 and typically has a total sulphur content of less than 30 ppm by weight, preferably less than 15 ppm by weight.

This desulphurized hydrocarbon cut HHCN advantageously constitutes a base for the formulation of gasoline type fuel, alone or as a mixture with the light gasoline cut LCN and/or the intermediate gasoline with low sulphur and mercaptans contents.

Figure 2:
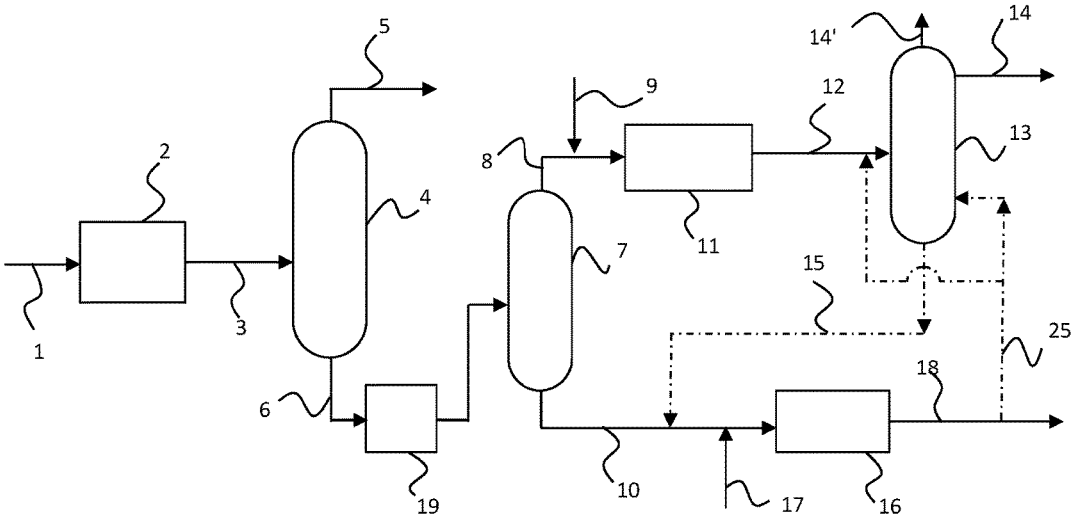
FIG. 2 is a flow chart of a variation of the process in accordance with the invention.

FIG. 2 represents another embodiment of the process in accordance with the invention which differs from that of FIG. 1 by the implementation of an optional intermediate hydrodesulphurization step when step a) can be used to separate the gasoline feed into three hydrocarbon cuts by means of a concatenation of two fractionations into two cuts. In this case, a first fractionation is carried out in a manner such that two cuts are obtained: the light gasoline cut LCN and an intermediate heavy gasoline cut HCN. The intermediate heavy cut HCN is then at least partially desulphurized in the optional hydrodesulphurization step and then fractionated in the second splitter in order to obtain the intermediate gasoline cut MCN and the heavy gasoline cut HHCN from the bottom of this same column.

This operational mode has the advantage of partially desulphurizing the intermediate heavy gasoline cut HCN and hence of enabling the hydrodesulphurization steps b) and d) to be operated under less severe operating conditions than those necessary in the same reactors in the case of FIG. 1 in order to limit hydrogenation of the olefins.

Referring now to FIG. 2, the intermediate heavy gasoline cut HCN is treated in a hydrodesulphurization unit which comprises at least one reactor 19 equipped with a fixed or moving bed of hydrodesulphurization catalyst. As is the case for each hydrodesulphurization treatment, the HCN cut is brought into contact with hydrogen and the catalyst.

Then, in step a) of the process in accordance with the invention, the HCN effluent withdrawn from the reactor 19 is fractionated in the column 7 in order to produce the intermediate gasoline cut MCN and the heavy cut HHCN. The steps b) to d) are identical to those described with reference to FIG. 1.

Figure 3:
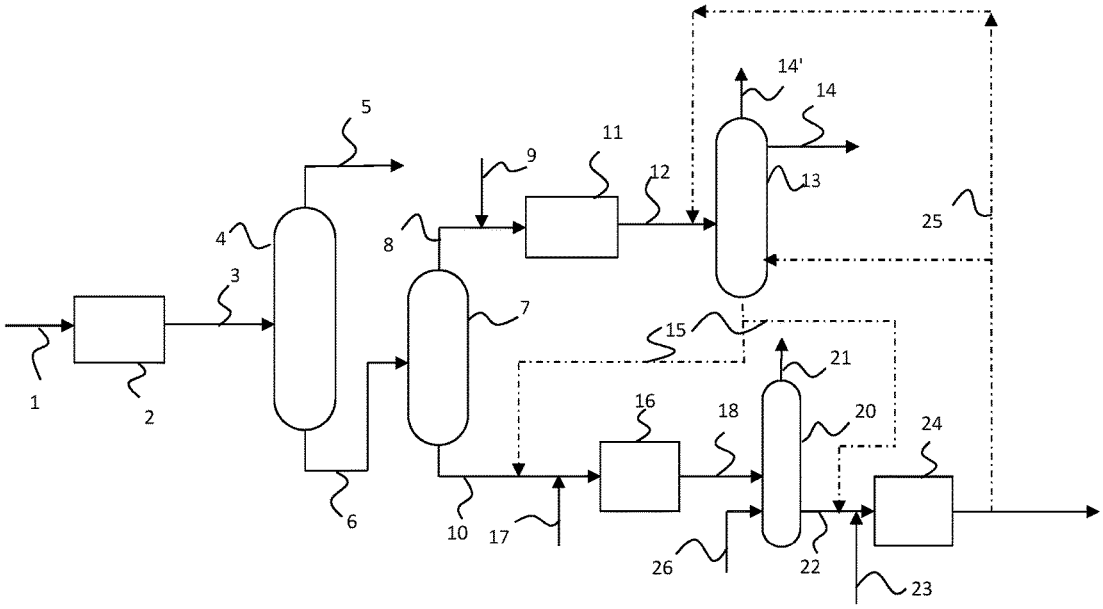
FIG. 3 is a flow chart of another variation of the process in accordance with the invention.

FIG. 3 represents another example of an embodiment of the process in accordance with the invention, in which step d) is carried out in a selective hydrodesulphurization unit comprising two reactors 16 and 24 disposed in series. A unit of this type can be operated with or without an intermediate step for degassing of the $H_2S$ formed in the first reactor 16 of the series. Preferably, step d) is operated with an intermediate step for degassing of $H_2S$.

As indicated in FIG. 3, the effluent 18 withdrawn from the first hydrodesulphurization reactor 16 is sent to a unit 20 configured to separate $H_2S$ from the effluent 18. In the example of FIG. 3, the effluent 18 is brought into contact with a gas such as hydrogen (supplied via the line 26) in an $H_2S$ stripping column, from which a gaseous stream 21 containing hydrogen and $H_2S$ is withdrawn overhead and an effluent 22 purified of $H_2S$ is withdrawn from the bottom. It should be noted that the gaseous stream 21 may advantageously be treated in order to separate the hydrogen from the $H_2S$ in a manner such as to produce a stream of purified hydrogen which can be recycled to the hydrodesulphurization unit, for example to the first hydrodesulphurization reactor 16. For the $H_2S$ elimination step, it is also possible to use, instead of a stripping unit, an absorption device employing amines, for example.

The effluent 22 purified of $H_2S$ is then sent to a second hydrodesulphurization reactor 24 in which it is brought into contact with hydrogen (line 23) and a selective hydrodesulphurization catalyst such as that already described above, so as to produce a hydrocarbon cut HHCN with a very low sulphur content. It should be noted that the bottom cut from the splitter described in step c) may be sent either to the inlet to the reactor 16, or to the inlet to the reactor 24 in order to be desulphurized.

It should be pointed out that step d) can clearly use a selective hydrodesulphurization unit comprising more than two reactors arranged in series, which is implemented with or without a step for elimination of $H_2S$ from the effluent between two successive hydrodesulphurization steps.

Figure 4:
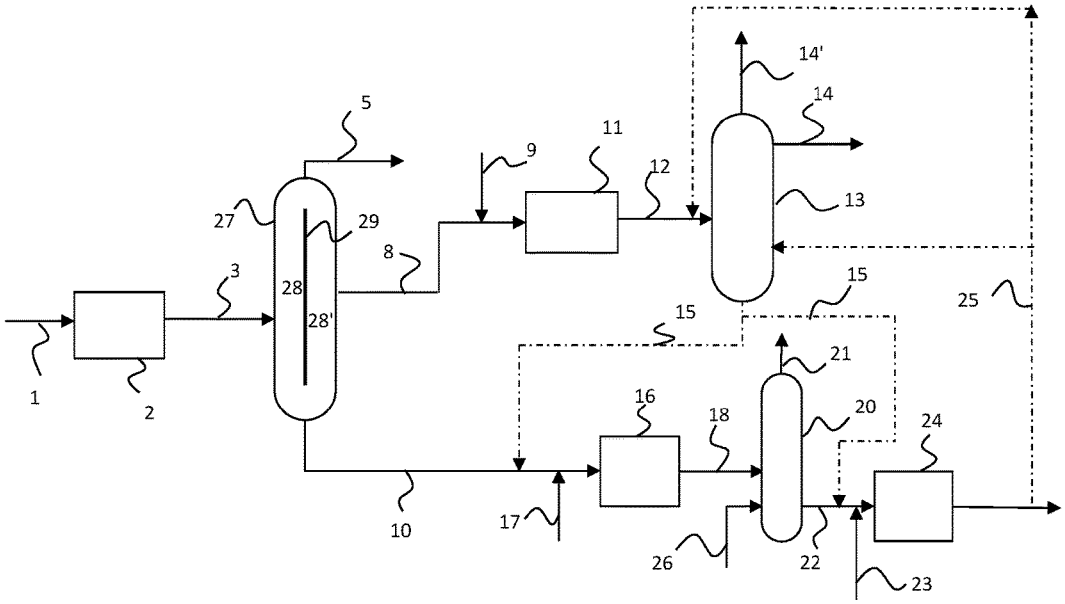
FIG. 4 is a flow chart of a further variation of the process in accordance with the invention.

FIG. 4 shows another embodiment of the process in accordance with the invention, in which step a) for fractionation of the gasoline into three cuts is carried out in a single fractionation step using a divided wall column. This type of column has been described in detail in the literature, for example in the publication Chemical Engineering and Processing, 49 (2010) pp 559-580. By way of example, this type of column can be used to separate three products with different volatilities in a single splitter instead of using two columns in series, which provides savings as regards energy and investment costs. The patents US 2003/0116474 A1, U.S. Pat. Nos. 6,927,314 B1 and 7,947,860 B2 illustrate applications of this type of column for the fractionation of gasolines into at least 3 cuts.

The principle of a divided wall column is to install, inside a splitter, a vertical wall in a median vertical part of the column. This separating wall extends between the opposite sides of the interior surface of the column. A seal installed between the vertical wall and the interior surface of the column provides a divided wall with a seal in a manner such that the fluids cannot pass horizontally from one side to the other of the column. The interior vertical wall divides the central portion of the column into two parallel fractionation zones or chambers (equivalent to two splitters). Each fractionation zone may contain conventional vapour-liquid contact equipment such as plates, packings or both, depending on the design of the column.

In the embodiment of FIG. 4, the column 27 comprises two fractionation chambers 28 and 28' separated by a vertical partition wall 29 arranged in a central section of the column which extends over both a portion of the fractional distillation section and over a portion of the bottom stripping section of the column. From the divided wall column 27, the light gasoline cut LCN, 5, is withdrawn directly overhead from the column, the heavy gasoline cut HHCN, 10, is withdrawn from the bottom of the column, and the intermediate gasoline cut MCN, 8, is withdrawn as a side stream from a stripping chamber 28'.

Figure 5:
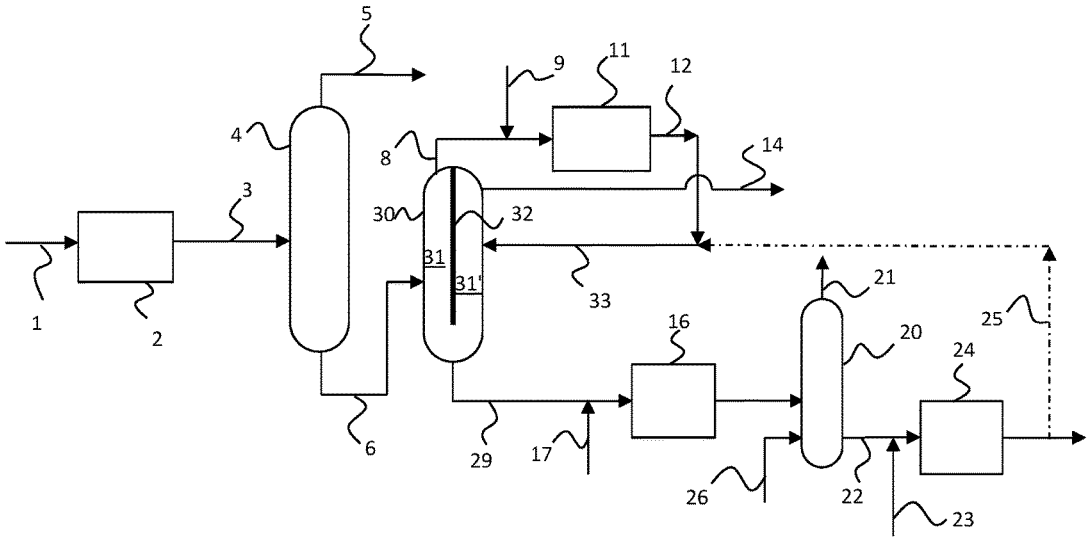
FIG. 5 is a flow chart of a further variation of the process in accordance with the invention.

FIG. 5 represents an alternative embodiment of the process in which step a) for fractionation into three cuts is carried out in two steps with two splitters, wherein the second column is a divided wall column and in which step c) for fractionation of the MCN cut containing recombinant mercaptans is also carried out in the divided wall column.

Referring to FIG. 5, the gasoline feed 1, after the optional selective hydrogenation step, is fractionated in a first column 4 configured to separate the light gasoline cut LCN, 4, overhead from the column and the intermediate heavy gasoline cut HCN, 6, from the column bottom. The intermediate heavy gasoline cut HCN 6 is then sent to a divided wall column 30 which comprises two fractionation chambers 31 and 31' which are separated by a vertical wall 32 which extends both over the entire rectification section and optionally also over a portion of the exhaust section of the column. Examples of the principle of this type of column are illustrated in the patents U.S. Pat. Nos. 5,755,933, 3,314,879 and 3,412,016.

As indicated in FIG. 5, the feed HCN 6, is sent to the fractionation chamber 31 from which the intermediate gasoline cut MCN, 8, is extracted overhead from said chamber 31. The intermediate gasoline cut MCN, 8, is then desulphurized in the hydrodesulphurization reactor 11, in accordance with step b). The effluent 12 obtained from the reactor 11 is sent via the line 33 to the second fractionation chamber 31' of the column 30 which is operated in order to separate the sulphur-containing compounds of the mercaptans type in a manner such as to produce an intermediate gasoline MCN with a low sulphur and mercaptans content which is withdrawn overhead from the fractionation chamber 31'. The mercaptans are then entrained in the bottom stripping section of the chamber 31' and withdrawn from the bottom of the column via the line 29 as a mixture with the HHCN cut. In accordance with step d), the heavy gasoline cut HHCN charged with sulphur-containing compounds is hydrodesulphurized in order to provide a HHCN cut with a low sulphur content.

Without further elaboration, it is believed that one skilled in the art can, using the preceding description, utilize the present invention to its fullest extent. The preceding preferred specific embodiments are, therefore, to be construed as merely illustrative, and not limitative of the remainder of the disclosure in any way whatsoever.

In the foregoing and in the examples, all temperatures are set forth uncorrected in degrees Celsius and, all parts and percentages are by weight, unless otherwise indicated. The entire disclosures of all applications, patents and publications, cited herein and of corresponding French application No. 16/53.105, filed Apr. 8, 2016, are incorporated by reference herein.

EXAMPLE

Hydrodesulphurization of a FCC Gasoline in Accordance with the Example of FIG. 1

Table 1 presents the characteristics of a FCC gasoline treated using the process in accordance with FIG. 1 of the present invention. In this example, the results are presented without the use of a selective hydrogenation reactor 2.

A gasoline FRCN was fractionated in order to obtain a light gasoline cut LCN and an intermediate heavy gasoline cut HCN. The intermediate heavy gasoline cut HCN was then fractionated, as proposed by the invention, into an intermediate gasoline cut MCN and a heavy gasoline HHCN. The analytical methods used to characterize the feeds and effluents were as follows:

- Density in accordance with the NF EN ISO 12185 method.
- Sulphur content in accordance with the ASTM D2622 method for contents higher than 10 ppm S and ISO 20846 for contents lower than 10 ppm S.
- Distillation in accordance with the "CSD" simulated distillation method described in the document Oil Gas Sci. Technol. Vol. 54 (1999), No. 4, pp. 431-438.
- The amount of olefins, which are high octane number compounds, was measured indirectly using the ASTM D1159 method, known as the bromine number.

TABLE 1

Characteristics of FCC HCN, MCN and HHCN cuts of FIG. 1

| | Line 6 HCN | Line 8 MCN | Line 10 HHCN |
|---|---|---|---|
| Density at 15° C. (g/cm$^3$) | 0.791 | 0.711 | 0.82 |
| Organic sulphur content (ppm S) | 1279 | 481 | 1543 |
| Mercaptans content (ppm S) | 13 | 23 | 10 |
| Simulated distillation | | | |
| 5% distilled weight (° C.) | 69 | 58 | 100 |
| 10% distilled weight (° C.) | 74 | 62 | 111 |
| 30% distilled weight (° C.) | 113 | 72 | 140 |
| 50% distilled weight (° C.) | 143 | 75 | 162 |
| 70% distilled weight (° C.) | 172 | 83 | 182 |
| 90% distilled weight (° C.) | 207 | 96 | 208 |
| 95% distilled weight (° C.) | 220 | 100 | 218 |
| 99.5% distilled weight (° C.) | 235 | 104 | 233 |

In accordance with the example of FIG. 1, the intermediate gasoline cut MCN was a cut for which the 5% distilled weight temperature was 58° C. and the 95% distilled weight temperature was 100° C. (points determined in accordance with the "CSD" simulated distillation method described in the scientific literature (Oil Gas Sci. Technol. Vol. 54 (1999), No. 4, pp. 431-438). For this intermediate gasoline cut MCN, the temperature difference between the 5% and 95% by weight distillation points was thus 42° C.

As indicated in the example of FIG. 1, the intermediate gasoline cut MCN was mixed with hydrogen and treated in a selective hydrodesulphurization unit (reactor 11) in the presence of a CoMo catalyst supported on alumina (HR806 marketed by Axens). The temperature was 240° C., the pressure was 2 MPa, the liquid space velocity (expressed as the volume of liquid per volume of catalyst per hour) was 4 $h^{-1}$, the $H_2$/MCN cut ratio was 360 normal liters per liter under standard conditions. The characteristics of the partially desulphurized intermediate gasoline cut MCN are indicated in Table 2.

The heavy gasoline cut HHCN was mixed with hydrogen and treated in a selective hydrodesulphurization unit (reactor 16) in the presence of a CoMo catalyst supported on alumina (HR806 marketed by Axens). The temperature was 298° C., the pressure was 2 MPa, and the liquid space velocity (expressed as the volume of liquid per volume of catalyst per hour) was 4 $h^{-1}$, the $H_2$/intermediate gasoline cut MCN ratio was 360 normal $m^3$ per $m^3$ under conditions standards. The characteristics of the partially desulphurized HHCN cut are indicated in Table 2.

The partially desulphurized intermediate gasoline cut MCN (line 12) was mixed with a fraction of the desulphurized heavy gasoline cut HHCN and sent to a splitter (13) (in accordance with step c) of the invention) for which the cut point had been fixed at 100° C. The partially desulphurized gasoline MCN, which had a low recombinant mercaptans content (line 14), was recovered overhead of the splitter 13. The characteristics of the intermediate gasoline (line 14) after stabilization are indicated in Table 2.

TABLE 2

Characteristics of MCN, intermediate gasoline and HHCN cuts in accordance with FIG. 1

| | Line 12 partially desulphurized MCN | Line 14 intermediate stabilized and desulphurized gasoline | Line 18 partially desulphurized HHCN |
|---|---|---|---|
| Total organic sulphur content (ppm S) | 104 | 10 | 10 |
| Mercaptans content (ppm S) | 98 | 4 | 8 |
| Bromine number (g/100 g) | 87 | 87 | 19 |

The process in accordance with the invention can therefore be used to produce an intermediate gasoline after the steps for hydrodesulphurization (step b) and fractionation (step c) with a low total sulphur content and with a mercaptans content of less than 10 ppm by weight, expressed as the sulphur equivalent, thereby limiting the hydrogenation of olefins.

It can be seen that before the hydrodesulphurization step, the intermediate gasoline cut MCN had a total organic sulphur content of 481 ppm by weight of sulphur, including 13 ppm by weight of sulphur from mercaptans. After the desulphurization step, the MCN effluent had a total organic sulphur content of 104 ppm of sulphur the major portion of which was in the form of recombinant mercaptans (98 ppm sulphur).

By means of the fractionation step c), which was carried out carefully in order to recover an intermediate gasoline with a narrow distillation range, an intermediate gasoline was obtained which had both a low total organic sulphur content (10 ppm by weight of sulphur) and mercaptans content (4 ppm by weight of sulphur). Thus, the process in accordance with the invention can be used to satisfy two constraints, namely providing a gasoline cut with a low (recombinant) mercaptans content and with a limited loss of octane number.

The preceding examples can be repeated with similar success by substituting the generically or specifically described reactants and/or operating conditions of this invention for those used in the preceding examples.

From the foregoing description, one skilled in the art can easily ascertain the essential characteristics of this invention and, without departing from the spirit and scope thereof, can make various changes and modifications of the invention to adapt it to various usages and conditions.

The invention claimed is:

1. A process for the treatment of a gasoline containing sulphur-containing compounds, olefins and diolefins, the process comprising:

a) fractionating the gasoline to recover at least one intermediate gasoline cut, MCN, comprising hydrocarbons and wherein the temperature difference (ΔT) between the 5% and 95% by weight distillation points is less than or equal to 60° C.;

b) desulphurizing the intermediate gasoline cut MCN alone and in the presence of a hydrodesulphurization catalyst and hydrogen, at a temperature of 160° C. to 450° C., at a pressure of 0.5 to 8 MPa, with a liquid space velocity of 0.5 to 20 $h^{-1}$ and with a ratio between the flow rate of hydrogen, expressed in normal $m^3$ per hour, and the flow rate of feed to be treated, expressed in $m^3$ per hour under standard conditions, of 50 $Nm^3/m^3$ to 1000 $Nm^3/m^3$ to produce a partially desulphurized intermediate gasoline cut MCN; and c) fractionating, in a splitter column, the partially desulphurized intermediate gasoline cut MCN which has not undergone catalytic treatment subsequent to b), to recover an intermediate gasoline from the column head and a cut of hydrocarbons containing sulphur-containing compounds including mercaptans from the column bottom, wherein the intermediate gasoline from the column head has a sulphur and mercaptans content less than the cut of hydrocarbons from the column bottom.

2. The process as claimed in claim 1, in which:

a) the gasoline is fractionated into at least:

a light gasoline cut LCN;

an intermediate gasoline cut, MCN, comprising hydrocarbons and wherein the temperature difference (ΔT) between the 5% and 95% by weight distillation points is less than or equal to 60° C.; and a heavy gasoline cut HHCN containing hydrocarbons;

b) the intermediate gasoline cut MCN is desulphurized alone and in the presence of a hydrodesulphurization catalyst and hydrogen, at a temperature of 160° C. to 450° C., at a pressure of 0.5 to 8 MPa, with a liquid space velocity of 0.5 to 20 $h^{-1}$ and with a ratio between the flow rate of hydrogen, expressed in normal $m^3$ per hour, and the flow rate of feed to be treated, expressed in $m^3$ per hour under standard conditions, of 50 $Nm^3/m^3$ to 1000 $Nm^3/m^3$ to produce an at least partially desulphurized intermediate gasoline cut MCN;

c) the partially desulphurized intermediate gasoline cut MCN which has not undergone catalytic treatment subsequent to b) is fractionated, in a splitter column, to recover an intermediate gasoline from the column head and a cut of hydrocarbons containing sulphur-containing compounds including mercaptans from the column bottom, wherein the intermediate gasoline from the column head has a sulphur and mercaptans content less than the cut of hydrocarbons from the column bottom;

d) the heavy gasoline cut HHCN is desulphurized alone or as a mixture with the bottom hydrocarbon cut obtained from c) in the presence of a hydrodesulphurization catalyst and hydrogen, at a temperature of 200° C. to 400° C., at a pressure of 0.5 to 8 MPa, with a liquid space velocity of 0.5 to 20 $h^{-1}$ and with a ratio between the flow rate of hydrogen, expressed in normal $m^3$ per hour, and the flow rate of feed to be treated, expressed in $m^3$ per hour under standard conditions, of 50 $Nm^3/m^3$ to 1000 $Nm^3/m^3$ to produce an at least partially desulphurized heavy HHCN cut.

3. The process as claimed in claim 1, in which the intermediate gasoline cut MCN has a temperature difference (ΔT) between the temperatures corresponding to 5% and 95% of the distilled weight which is 20° C. to 60° C.

4. The process as claimed in claim 2, in which a) is carried out in two fractionations:

a1) fractionating the gasoline into a light gasoline cut LCN and an intermediate heavy gasoline cut HCN;

a2) fractionating the intermediate heavy gasoline cut HCN into at least one intermediate gasoline cut MCN and a heavy gasoline cut HHCN.

5. The process as claimed in claim 4, in which the intermediate heavy gasoline cut HCN obtained from a1) is desulphurized before the fractionation a2).

6. The process as claimed in claim 2, in which a) is carried out in a single fractionation.

7. The process as claimed in claim 6, in which a) is carried out in a divided wall column.

8. The process as claimed in claim 4, in which a2) is carried out in a divided wall column and in which the partially desulphurized intermediate gasoline cut MCN obtained from b) is fractionated in said divided wall column.

9. The process as claimed in claim 1, in which the intermediate gasoline cut MCN from a) has temperatures corresponding to 5% and 95% of the distilled weight which are respectively 50° C. to 68° C. and 88° C. to 110° C.

10. The process as claimed in claim 1, in which the intermediate gasoline obtained from c) has a temperature difference (ΔT) between the temperatures corresponding to 5% and 95% of the distilled weight which is equal to the temperature difference (ΔT) of the intermediate gasoline cut MCN obtained from a).

11. The process as claimed in claim 1, in which the intermediate gasoline obtained from c) has a temperature corresponding to 95% of the distilled weight which is a maximum of 10° C. lower with respect to the temperature corresponding to 95% of the distilled weight of the intermediate gasoline cut MCN of a).

12. The process as claimed in claim 2, in which step d) employs a first and a second hydrodesulphurization reactor disposed in series.

13. The process as claimed in claim 12, in which the effluent obtained from the first hydrodesulphurization reactor undergoes stripping of $H_2S$ before being treated in the second hydrodesulphurization reactor.

14. The process as claimed in claim 2, in which a portion of the desulphurized heavy gasoline cut HHCN obtained from d) is recycled to c).

15. The process as claimed in claim 1 in which, before a), the gasoline is treated in the presence of hydrogen and a selective hydrogenation catalyst to hydrogenate the diolefins and carry out a reaction for increasing the molecular weight of a portion of the sulphur-containing compounds, the selective hydrogenation being operated at a temperature of 50° C. to 250° C., at a pressure of 1 to 5 MPa, with a liquid space velocity of 0.5 to 20 $h^{-1}$ and with a ratio between the flow rate of hydrogen, expressed in normal $m^3$ per hour, and the flow rate of feed to be treated, expressed in $m^3$ per hour under standard conditions, of 2 $Nm^3/m^3$ to 100 $Nm^3/m^3$.

16. The process as claimed in claim 1, in which the intermediate gasoline cut MCN has a temperature difference (ΔT) between the temperatures corresponding to 5% and 95% of the distilled weight which is 25° C. to 40° C.

* * * * *